US007410013B2

(12) United States Patent
Fisher

(10) Patent No.: US 7,410,013 B2
(45) Date of Patent: Aug. 12, 2008

(54) BORING AND DRILLING APPARATUS

(75) Inventor: Hugh Edward Fisher, Dalrymple Ayrshire (GB)

(73) Assignee: Wave Craft Limited, Dubai (AE)

( * ) Notice: Subject to any disclaimer, the term of this patent is extended or adjusted under 35 U.S.C. 154(b) by 0 days.

(21) Appl. No.: 10/450,066

(22) PCT Filed: Dec. 3, 2001

(86) PCT No.: PCT/GB01/05331

§ 371 (c)(1),
(2), (4) Date: Mar. 15, 2004

(87) PCT Pub. No.: WO02/46564

PCT Pub. Date: Jun. 13, 2002

(65) Prior Publication Data

US 2004/0144566 A1 Jul. 29, 2004

(30) Foreign Application Priority Data

Dec. 9, 2000 (GB) ..... 0030134.1
Sep. 7, 2001 (GB) ..... 0121654.8

(51) Int. Cl.
*E21B 4/10* (2006.01)

(52) U.S. Cl. ..... 175/106; 175/298; 175/319; 175/415; 175/417; 175/418

(58) Field of Classification Search ..... 175/64, 175/106, 257–260, 274, 291, 298, 319, 414, 175/415, 417, 418, 171; 166/57, 380, 285
See application file for complete search history.

(56) References Cited

U.S. PATENT DOCUMENTS 1,607,082 A 11/1926 Howcott
1,741,497 A * 12/1929 Boltz ..... 175/171
2,120,240 A 6/1938 Chappell ..... 255/74
2,634,951 A * 4/1953 Snyder ..... 175/298
2,713,992 A 7/1955 Snyder ..... 255/3
2,877,984 A * 3/1959 Causey ..... 175/106
2,950,087 A * 8/1960 Gregory ..... 175/171
3,918,523 A * 11/1975 Stuber ..... 166/285
3,934,066 A 1/1976 Murch ..... 428/248

(Continued)

FOREIGN PATENT DOCUMENTS

DE 32 00 881 A1 7/1983

(Continued)

*Primary Examiner*—Richard E. Chilcot, Jr.
*Assistant Examiner*—Matt J Smith
(74) *Attorney, Agent, or Firm*—Steptoe & Johnson LLP

(57) ABSTRACT

An apparatus (10) for use in boring is described, the apparatus including a rotatable drive shaft (12), a cam member (20) and followers (16) for converting rotational motion into reciprocal motion, and a shroud (24) having a cutting edge (26) driven by the cam member and followers. The shroud may be selectively engageable with the cam member and followers, allowing the drive shaft to be removed through the shroud. A fluid circulation arrangement (31), (13) allows air to be injected into loose drilling substrate, so assisting removal of drill cuttings from the boring apparatus. Also described is a drill string incorporating a similar arrangement, allowing the drill string to be reciprocated within a bore. The drill string may further include casing sections, which may have intumescent coatings to allow the sections to be fixed in a wellbore.

55 Claims, 10 Drawing Sheets

U.S. PATENT DOCUMENTS

| | | | | | |
|---|---|---|---|---|---|
| 4,024,919 | A | * | 5/1977 | Pujol | 166/57 |
| 4,253,531 | A | | 3/1981 | Boros | 175/56 |
| 4,890,676 | A | * | 1/1990 | Mason | 166/380 |
| 5,156,223 | A | * | 10/1992 | Hipp | 175/106 |

FOREIGN PATENT DOCUMENTS

| | | | |
|---|---|---|---|
| EP | 0 391 161 | A2 | 10/1990 |
| GB | 725175 | | 3/1955 |
| WO | WO 02/14028 | A2 | 2/2002 |

* cited by examiner

BORING AND DRILLING APPARATUS

Cross-Reference to Related Applications

This application is the national phase of International (PCT) patent application Ser. No. PCT/GB01/05331, filed Dec. 3, 2001, published under PCT Article 21 (2) in English, which claims priority to and the benefit of British Patent Application No. 0030134.1, filed Dec. 9, 2000, and British Patent Application No. 0121654.8, filed Sep. 7, 2001, the disclosures of which are herein incorporated by reference.

The present invention relates to an apparatus for use in boring and drilling; and in particular, but not exclusively, for use in boring or drilling in soil, sand, shale and the like. Certain embodiments of the invention relate to boring apparatus for use in drilling boreholes for use in the oil and gas exploration and production industries. The invention further relates in certain aspects to an apparatus and a method for drilling and casing boreholes for the oil and gas exploration and production industries.

Conventional drilling arrangements, as used for example in the oil and gas extraction industries, typically make use of an abrasive or cutting drill bit mounted on a rotatable drill string. Rotation of the drill string causes the drill bit itself to rotate, and to attack the substrate to be drilled. Such drilling arrangements work well when drilling into hard rock or the like, but tend to have poorer performance when drilling into soft substrates such as soil, sand or shale.

Further, when drilling into rock or the like, the drill typically requires the circulation of drilling mud or drilling fluid around the drill bit. This is a liquid preparation of particular chemical composition designed to entrain and help remove drill cuttings from the drilling face, and is selected to be chemically unreactive for the substrates and at the temperatures likely to be encountered. These requirements for the drilling mud result in drilling mud being relatively expensive to provide; in addition the environmental impact of drilling mud can be adverse.

Further, it is typical practice when drilling boreholes in the oil and gas industries to 'case' the borehole after drilling. This involves removing the drill string from the borehole, and lowering tubular casing sections into the hole. Cement or other fixing material is then pumped downhole into the annulus between the casing and the bore walls, and allowed to set. This provides a seal between the casing and the bore, so preventing fluids from passing into this region, and provides a secure fixing between the casing and the bore wall. This process is however time consuming and complex.

It is among objects of embodiments of the present invention to obviate or at least alleviate these and other disadvantages of known drilling arrangements.

According to a first aspect of the present invention, there is provided a boring apparatus comprising a rotatable drive shaft, a boring member, and means for converting rotational motion of the drive shaft into longitudinal reciprocal motion of the boring member.

Preferably the boring member may comprise a tubular member. Preferably a leading end of the tubular member may taper from a main body portion of the tubular member to a peripherally extending leading edge thereof.

Preferably the boring member further comprises a body mounted on the drive shaft. The body may be rigidly connected to the tubular member by one or more radially extending members. The radially extending members may each include a tapering leading edge. In certain embodiments of the invention, the body may be selectively engageable with the tubular member. Preferably the body and tubular member are arranged to engage or remain engaged on rotation of the body in a first direction, and disengage on rotation of the body in a second direction. Conveniently the apparatus may comprise shaped recesses or the like on one of the body and the tubular member for engaging with radially extending members connected to the other of the body and the tubular member. Alternatively, clamps, hooks, grippers or the like may be used.

Preferably the means for converting rotational motion of the drive shaft to longitudinal motion of the boring member may comprise at least one cam track arrangement on one of the drive shaft and boring member, and at least one corresponding cam follower member on the other of the drive shaft and the boring member.

The or each cam track may provide a regular (repeating) path or an irregular (non-repeating) path.

The cam track may be substantially sinusoidal, non-sinusoidal, dogtooth, sawtooth, or the like in shape.

Preferably the boring apparatus comprises means for evacuating bored material from the boring member.

Preferably the boring apparatus further comprises means for directing a flow of gas such as air or the like at material to be bored or which has been bored. In this way the material may be disrupted and/or loosened so as to facilitate evacuation thereof.

In a number of modified embodiments the boring apparatus may further include rotational boring means which may be provided ahead of the boring member and which may be driven by the drive shaft. The rotational boring means may further be adapted for reciprocal motion as well as rotational motion. For example, the rotational boring means may be rotationally driven directly by the drive shaft, while being operatively linked to the boring member to transmit reciprocal motion thereof to the rotational boring means. In selected embodiments of the invention, the rotational boring means may be adjustable to a position in which the radius of the rotational boring means is less than the radius of the boring member, so allowing the rotational boring means to pass through the boring member to permit the boring means to be removed from the apparatus. Conveniently the rotational boring means may comprise foldable or retractable cutting members. These may be foldable or retractable on movement of the rotational boring means in a first axial direction, but not on movement in a second axial direction.

According to a second aspect of the present invention there is provided a boring member adapted for use in a boring apparatus according to the first aspect of the present invention.

According to a third aspect of the present invention, there is provided an apparatus for boring, the apparatus comprising a rotatable drive shaft, drive means for rotating the drive shaft, a drilling member mounted on the drive shaft by mounting means, the mounting means comprising means for converting at least some of the rotary motion of the drive shaft into reciprocal motion of the drilling member, and a fluid circulation arrangement for supplying fluid to the drilling member and removing fluid therefrom.

Thus, the present invention allows a drilling member to be reciprocally moved against a drilling substrate; such a motion has been found to be particularly effective when drilling in softer substrates such as soil, sand or shale. The conversion means may convert all or only some of the rotary motion of the drive shaft into reciprocal motion; that is, the drilling member may rotate while drilling in addition to reciprocating.

The fluid circulation arrangement may be arranged to supply drilling mud, water, or other liquid to the drilling member; preferably however the fluid circulation arrangement is arranged to supply a gas to the drilling member; and more preferably the gas is air. Use of the present invention in softer substrates has the result that use of drilling mud is not necessary, and that air or other gas may be used instead. Supply of gas to the drilling member has the result of injecting the gas into a loosened particulate substrate, resulting in a 'fluid-like' substrate where the drilling member has penetrated the substrate. Such a 'fluid-like' substrate may be removed from the vicinity of the drilling member by the fluid circulation arrangement, so leaving the drilling member relatively clear of drill cuttings and the like. Thus, the apparatus may be used for longer periods without the drilling member becoming clogged or otherwise disrupted by a buildup of drilling waste.

Preferably the mounting means comprises a cam track arrangement on one of the drive shaft and drilling member, and a cam follower member on the other of the drive shaft and drilling member. The cam follower may be arranged to travel in the cam track. Use of a suitably shaped cam track will ensure that rotation of one of the cam track and cam follower will cause reciprocation of the other of the cam track and the cam follower. Preferably the cam follower is provided on the drive shaft, and the cam track is provided on the drilling member. One or more cam followers may be provided; similarly, one or more cam tracks may be provided. The cam track may be substantially sinusoidal, to provide a regular reciprocating motion; or the cam track may be non-sinusoidal, to provide a particular desired motion. For example, a 'dog-tooth' cam track may be provided, to impart a greater forward acceleration to the drilling member than rearward. Other possible cam track arrangements are described in our co-pending patent application GB 0019919.0, the contents of which are incorporated herein by reference.

Preferably the fluid circulation arrangement comprises a fluid delivery conduit extending to the drilling member; and a fluid removal conduit extending from the drilling member. The fluid delivery conduit may extend alongside the drive shaft; preferably however the drive shaft is hollow, and the fluid delivery conduit is formed by at least a portion of the drive shaft. The fluid delivery conduit may comprise one or more fluid delivery ports for permitting the escape of fluid from the conduit to the environment of the drilling member. The delivery ports may be directed rearwardly with respect to the direction of fluid delivery flow; this has the effect of injecting fluid into the drilling waste away from the site of drilling itself, and has been found to result in an improved flow of drilling waste away from the drilling member.

The fluid removal conduit preferably comprises a spoil evacuation tube. The apparatus preferably further comprises a shroud or the like surrounding the fluid delivery conduit and directing fluid from the drilling member to the fluid removal conduit. The shroud is conveniently part of the drilling member. Preferably the fluid removal conduit further comprises lifting means for assisting the transport of fluid along the removal conduit; conveniently the lifting means comprises a screw thread or the like arranged to rotate with the drive shaft; thus, the thread will act as an Archimedes screw and assist the transport of drilling waste and the like away from the drilling member and along the fluid removal conduit.

The fluid delivery conduit may be arranged to supply fluid under positive pressure to the drilling member; this aids in drilling waste removal. The fluid removal conduit may rely on this positive pressure for removal of fluid; or the removal conduit may itself be under negative pressure to assist the removal of fluid from the drilling member.

Preferably the drilling member comprises an annular shroud arranged about a central mounting means for mounting the member on the drive shaft. The annular shroud may be releasably mounted to the drive shaft. Conveniently, for example, the shroud is arranged to be releasable from the drive shaft on rotation of the drive shaft in a first direction, while engaging with or remaining mounted to the drive shaft on rotation of the drive shaft in a second direction. Preferably the mounting means comprises a plurality of fitting members attached to one of the shroud and the drive shaft, and a plurality of shaped receiving members attached to the other of the shroud and the drive shaft, the receiving members being shaped to capture the fitting members on rotation in a second direction. The annular shroud preferably is provided with cutting edges for penetrating a drilling substrate. The drilling member preferably further comprises a number of ribs or spokes connecting the central mounting means to the annular shroud; preferably also the ribs or spokes are provided with cutting edges. The ribs or spokes may be selectively connected to the annular shroud or to the central mounting means. The provision of ribs or spokes not only strengthens the drilling member, but also assists in the break-up of drilling substrate and the subsequent removal of drilling waste from the drilling member. The drilling member preferably further comprises a protruding nose extending beyond the remainder of the shroud; preferably the nose is provided with a cutting or penetrating point or the like, for breaking up or otherwise attacking drilling substrate.

Preferably the apparatus further comprises a secondary drilling member, the secondary member being rotatably drivable by the drive shaft. Preferably the secondary member is arranged to extend beyond the primary drilling member. Conveniently the secondary member comprises part of the drive shaft. The secondary member may comprise means for breaking up or otherwise attacking a drilling substrate. For example, the secondary member may comprise a grinding head, or a cutting head, or a cutting screw, or the like. The member may thus be used to aid the drilling effect of the primary drilling member by loosening or otherwise attacking the drilling substrate. The secondary member may be retractable or foldable to allow the secondary member to be passed through the drilling member. The secondary member may be reciprocally movable as well as rotatably movable. For example, the secondary member may be loosely mounted to the drive shaft to allow a small degree of reciprocal movement; and/or the secondary member may be operatively associated with the drilling member, such that reciprocal movement of the drilling member drives reciprocal movement of the secondary member. Conveniently the fluid circulation arrangement may be arranged to supply fluid to the secondary drilling member; this may be used to assist the drilling action of the secondary member. The supply of fluid to the secondary member may be selective; that is, fluid may be provided to the secondary member only as and when desired.

The apparatus may be arranged to be used in combination with a separate drilling support arrangement; for example, the apparatus may be arranged to be driven from surface, much as with conventional oil and gas drilling arrangements, with drilling waste being delivered to surface by the fluid circulation arrangement. Alternatively, the apparatus may be provided as a substantially self-contained unit, capable of drilling without support from surface. This may be of use in exploration, or the provision of boreholes for services, for example water, gas, electricity, telecommunications or the like, and particularly in laying of underground cables and the like. Displaced drilling waste may be simply deposited behind the apparatus as it drills into the substrate.

According to a further aspect of the present invention, there is provided a drill string assembly comprising a rotatable drive shaft, drive means for rotating the drive shaft, a tubular shroud, and mounting means for selectively mounting the shroud to the drive shaft.

Preferably the mounting means converts at least some of the rotary motion of the drive shaft to reciprocal motion of the shroud.

Preferably the assembly includes a drilling member in the form of a drill head extending beyond and before the shroud.

Preferably the drill head is operatively connected to the drive shaft to provide rotational motion of the drill head. Preferably also the drill head can experience reciprocal motion. Conveniently the drill head may be loosely mounted to the drive shaft, and/or may be operatively associated with the shroud to provide reciprocal motion.

The present invention is suited for use as a drill string assembly for use in the oil and gas exploration and production industries. The shroud and the drilling member of the present invention may be reciprocated at far higher rates than conventional oil drilling assemblies, so providing more efficient drilling, and a smoother borehole wall. The selective engagement of the drive shaft and the shroud permits the drive shaft to be disengaged from the shroud and removed when desired, while the shroud may be left downhole.

This ability together with the smoother bore walls permits a drill string according to the present invention to be run into a borehole and immediately followed with casing sections; it is not necessary to remove the entire drill string before running in the casing.

Preferably, therefore, the drill string assembly further comprises one or more casing sections. These sections are preferably disposed behind (that is, towards surface with respect to) the shroud.

Preferably the drill head is selectively movable between a first position of substantially the same radius as the shroud, and a second position of lesser radius than the shroud. This allows the drill head to be removed upwardly through the shroud. Conveniently the drill head comprises one or more hinged cutting blades which may be folded between first and second positions.

Preferably the shroud comprises a tubular member connected to a body, the body being mounted to the drive shaft. The tubular member may be connected to the body by means of a plurality of radially extending members. The members may be fixed to one of the body and the tubular member, and selectively engageable with the other of the body and the tubular member. Conveniently this is achieved by means of shaped pockets or recesses for engaging with an end of the radial members. Preferably the pockets or recesses are shaped to engage the radial members on rotation of the members in a first direction, and to release the radial members on rotation of the members in a second direction. Preferably the radial members include cutting edges. Conveniently the tubular member includes a cutting edge on a forward edge thereof.

Preferably the drill string further comprises fluid circulation means for circulating fluid to the secondary drilling member.

Preferably the drill string further comprises additional shrouds reciprocally mounted to the drive shaft. These may be located periodically along the drill string, interspersed with casing sections. This arrangement will reciprocate points along the whole of the length of the drill string. If the drill string reaches an obstacle and becomes stuck, this reciprocation will tend to jar the string free, so reducing the downtime lost to sticking of the drill string. Any or all of these shrouds may, of course, be selectively engageable with the drive shaft.

Preferably the casing sections of the present drill string include precast concrete or similar coatings. This serves to protect the casing sections from conditions found downhole, while reducing the need to pump liquid concrete downhole when casing the bore.

The drill string may further comprise intumescent coatings on selected portions of the casing sections. Preferably the intumescent coatings are selected to intumesce at a selected predetermined temperature. It will be apparent to the person of skill in the art how intumescent materials may be selected to intumesce at a particular temperature. The intumescent coating material may be selected from, for example, among the various materials useful as intumescents described in U.S. Pat. No. 3,934,066 to Murch, or could be an epoxy resin, vinyl resin, silicone resin, sodium silicate, latex, phenolic resin, silicone rubber, butyl rubber, magnesium oxide, or magnesium chloride, either alone or usually in combination with one or more other ingredients. Various other suitable intumescent materials will readily occur to the person of skill in the art. Preferably also the drill string comprises means for heating the intumescent coatings; conveniently this may comprise heating elements or the like embedded in the intumescent coatings, and operable from surface.

Such coatings will expand when actuated to provide a fluid tight seal between a portion of the casing section and the bore wall, and will further serve to anchor the casing section to the bore wall. This thus avoids the need to pump liquid concrete downhole. Conveniently the intumescent coatings may be provided adjacent joints between successive casing sections; where the casing sections are precoated with concrete, some part of the joint must be left uncoated to allow for successive sections to be fastened together; this provides a suitable location for the intumescent coatings to be applied.

According to a further aspect of the present invention, there is provided a method of drilling and casing a wellbore, the method comprising the steps of:

running a drill string assembly into a bore, the assembly comprising a rotatable drive shaft, drive means for rotating the drive shaft, a tubular shroud, mounting means for selectively mounting the shroud to the drive shaft and for converting at least some of the rotary motion of the drive shaft to reciprocal motion of the shroud, and a drilling member in the form of a drill head extending beyond and before the shroud;

running at least one casing section into the bore on the drill string assembly;

unmounting the shroud from the drive shaft; and removing the drilling member and the drive shaft from the bore, to leave the shroud and the casing sections in the bore.

According to a still further aspect of the present invention, there is provided a method of casing a section of a wellbore, the method comprising the steps of:

running a casing section into a wellbore; and causing an intumescent material to intumesce, to fix the casing section in the wellbore.

Preferably the intumescent material is provided on the casing section as a coating.

According to a yet further aspect of the present invention, there is provided a casing section for use in a wellbore, the section comprising a tubular member having an intumescent material or coating on at least a portion thereof.

The casing section may further comprise means for activating the intumescent coating. Preferably said means comprises means for heating the coating. Conveniently the heating means comprises a heating element or the like; this element may conveniently be located within or beneath the coating.

According to a yet further aspect of the present invention, there is provided a wellbore casing section made at least partly from concrete.

The casing section may have a precast concrete coating over at least a portion thereof.

Although the use of the apparatus has been principally described with reference to oil and gas exploitation, it will be apparent to the skilled person that the present invention has a wide application in all fields where boring or drilling is required.

These and other aspects of the present invention will now be described by way of example only and with reference to the accompanying drawings, in which.

Figure 1:
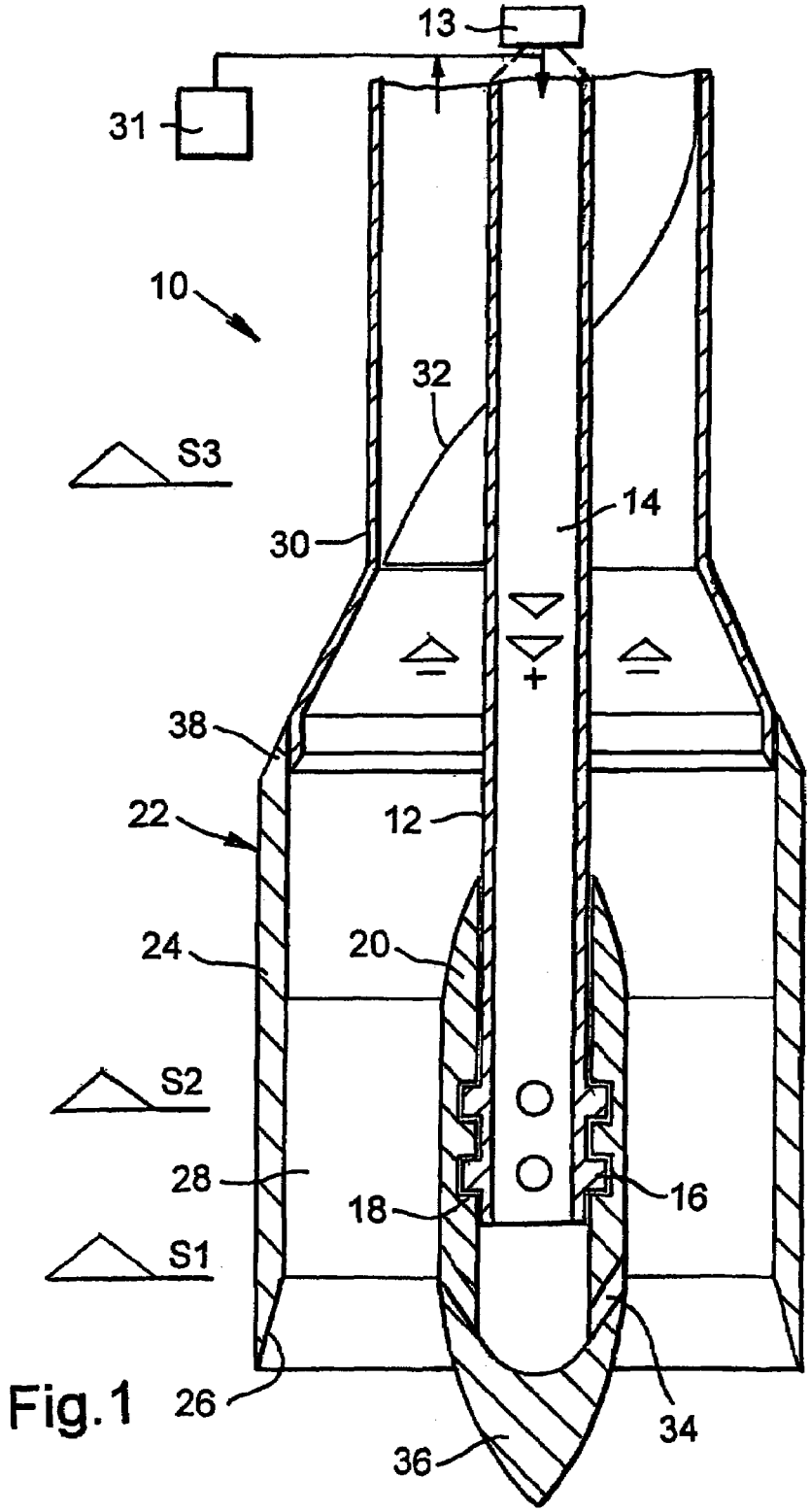
FIG. 1 shows a sectional view of a boring apparatus in accordance with a first embodiment of the present invention.
Figure 6:
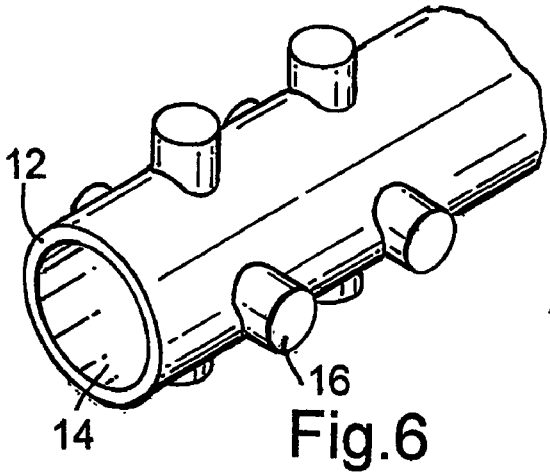
FIGS. 6 and 7 show perspective and sectional views respectively of a drive shaft of the apparatus of FIG. 1.
Figure 7:
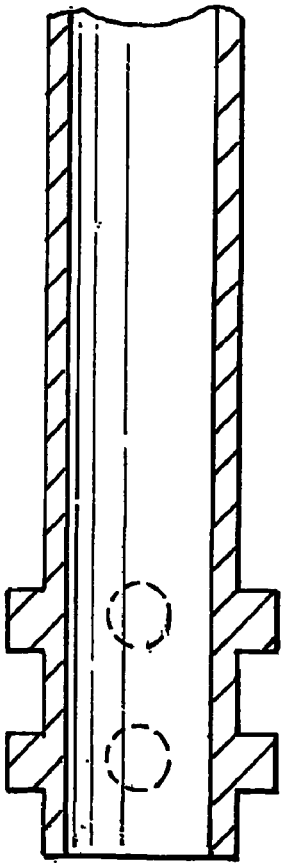

Referring firstly to FIG. 1, there is shown a sectional view of an apparatus for boring, generally designated 10, in accordance with an embodiment of the present invention. The apparatus 10 comprises a central rotatable drive shaft 12 having an internal bore 14 formed therethrough. The drive shaft 12 is connected to a rotary motor 13 (shown schematically) which drives the shaft 12 in a rotary motion. A lead portion of the drive shaft 12 is provided with a number of cam follower members 16 in the form of studs, seen most clearly in FIG. 6.

Figure 8:
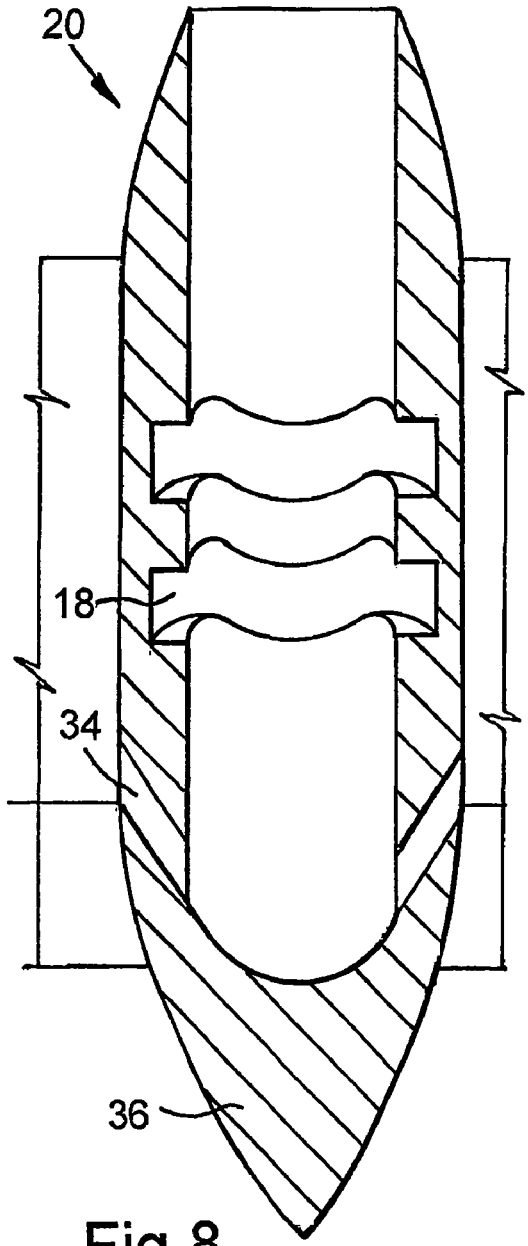
FIG. 8 shows a sectional view of a portion of a boring member of the apparatus of FIG. 1.

The cam follower members 16 are received in cam tracks 18 formed on an inner surface of a cam member 20. The cam member 20 is shown in greater detail in sectional view in FIG. 8; it can be seen that the cam tracks 18 are in this example substantially sinusoidal; however, any suitable cam track arrangement may be used. It will be apparent to those of skill in the art that the particular cam track arrangement used will affect the motion of the cam member 20 as the drive shaft 12 rotates. Further, while eight cam follower members and two cam tracks are shown in this example, any number of tracks and followers may be used, depending on the intended purpose of the apparatus.

A lead tip 36 of the cam member 20 comprises an armoured 'nose' portion, forming a point.

Figure 2:
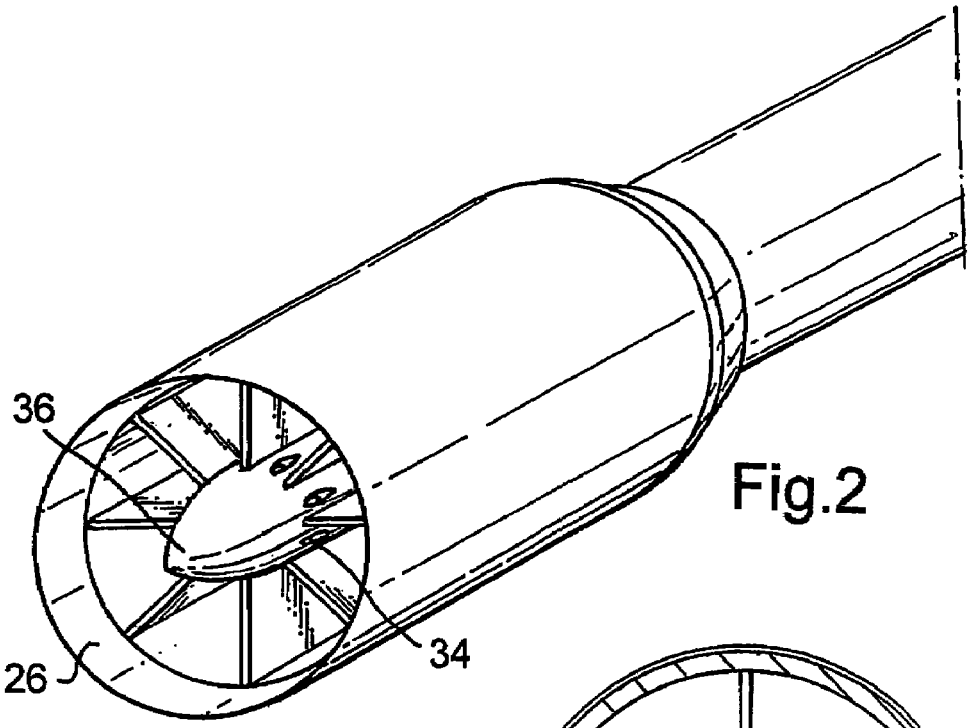
FIG. 2 shows an isometric view of a boring portion of the apparatus of FIG. 1.

Surrounding the cam member 20 is a boring or drilling member 22 in the form of a tubular member or annular shroud 24 having a cutting edge 26 formed on a lead edge thereof. The shroud 24 is connected to the cam member 20 and supported by a number of radially-extending spokes 28 (seen most clearly in FIG. 2), each of which is also provided with a lower cutting edge. The tip 36 of the cam member 20 protrudes beyond the cutting edge 26 of the shroud 24.

The shroud 24 is connected to a spoil evacuation tube 30, which forms a conduit leading away from the cutting edge 26. An outer surface of the drive shaft 12 is provided with a helical screw thread 32 over that portion of the shaft 12 contained within the spoil evacuation tube 30.

Both the spoil evacuation tube 30 and the drive shaft 12 are connected to an air circulation pump 31 (shown schematically); the pump 31 is used to compress air and send it down the bore 14 of the drive shaft 12, and to remove air from the spoil evacuation tube 30. Air can escape from the drive shaft 12 to the spoil tube 30 via rearwardly-directed vents 34 formed in the cam member 20.

Figure 3:
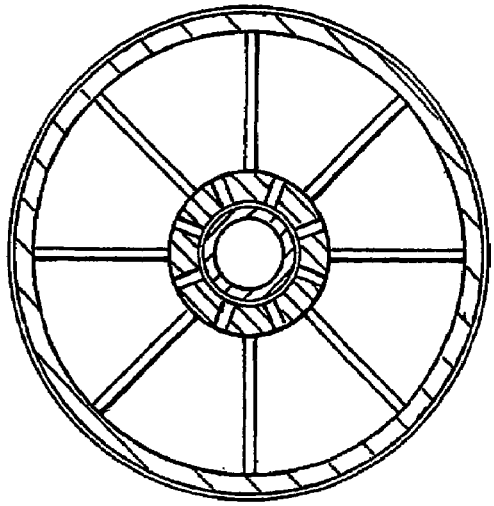
FIG. 3 shows a sectional view of the apparatus of FIG. 1 along line S1.
Figure 4:
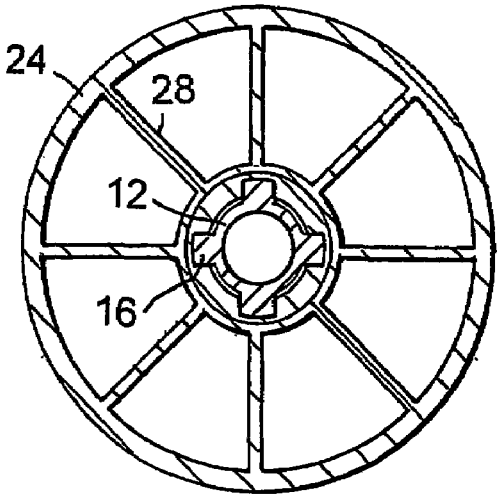
FIG. 4 shows a sectional view of the apparatus of FIG. 1 along line S2.
Figure 5:
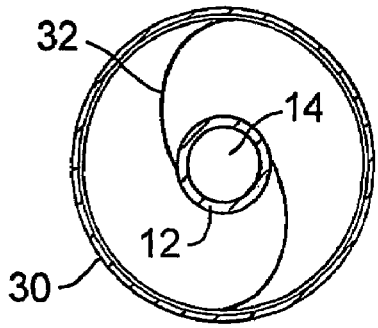
FIG. 5 shows a sectional view of the apparatus of FIG. 1 along line S3.

Further details of the apparatus 10 are illustrated in FIGS. 3 to 5, these being horizontal cross sectional views of the apparatus 10 taken along lines S1, S2, and S3 respectively.

Use of the apparatus 10 is as follows. The motor 13 of the apparatus is first activated, causing the drive shaft 12 to rotate. Since there is no stop or similar means on the drilling member 22, this also rotates along with the drive shaft 12. In certain embodiments of the invention, however, such stops may be provided, to prevent rotational movement of the drilling member 22. The air circulation pump 31 is then activated, pumping air downward along the drive shaft 12, out of the vents 34, and upwardly back along the spoil evacuation tube 30.

When the apparatus 10 is ready to bore or drill, the tip 36 and/or at least part of the cutting edge 26 of the drilling member 22 is pressed against the drilling substrate; in this example, soil. As the member 22 contacts the soil, resistance to rotation of the member 22 will be experienced, resulting in the arrest of rotational motion of the member 22 and the commencement of reciprocating motion of the drilling member 22, caused by the rotation of the cam follower members 16 within the cam tracks 18 of the cam member 20.

The tip 36 of the cam member 20 reciprocates against the soil first of all, followed by contact between the soil and the cutting edge 26 of the shroud 24. The point 36 serves to initially break up any hard clods or lumps of soil, allowing the cutting edge 26 of the shroud 24 to penetrate the soil more easily. As air is forced out of the vents 34 of the cam member 20, the soil is mixed with the injected air to form a fluid-like flow of entrained particulates. The flow is drawn rearward (in the Figures, upward) through the shroud 24 to enter the spoil evacuation tube 30, where transport and removal of drilling waste is assisted by the Archimedean screw movement of the helical thread 32 provided on the drive shaft 12.

The flow of compressed air to the drilling member 22 also serves the additional function of cooling cutting surfaces and moving parts of the apparatus 10.

Rotational movement of the drilling member 22 will be limited once the member 22 is in contact with the soil; however, some movement may still occur, for example, on the upward stroke of the member 22. If it is desired to eliminate this movement, stops or the like may be added to the cam member 20 to prevent any such rotational movement. The stops may be selectively engageable, to selectively prevent or permit such movement.

When the apparatus 10 has drilled to the desired depth, the apparatus 10 may be removed from the bore simply by lifting it out. The use of a purely reciprocating movement, rather than rotational, should result in smoother bore walls than with conventional drilling arrangements. If however some obstacle to removal of the boring apparatus 10 is encountered, the drilling member 20 may be made to reciprocate once more; the chamfered upper edges 38 of the shroud 24 will assist the movement of the apparatus upward through soft substrates.

Figure 9:
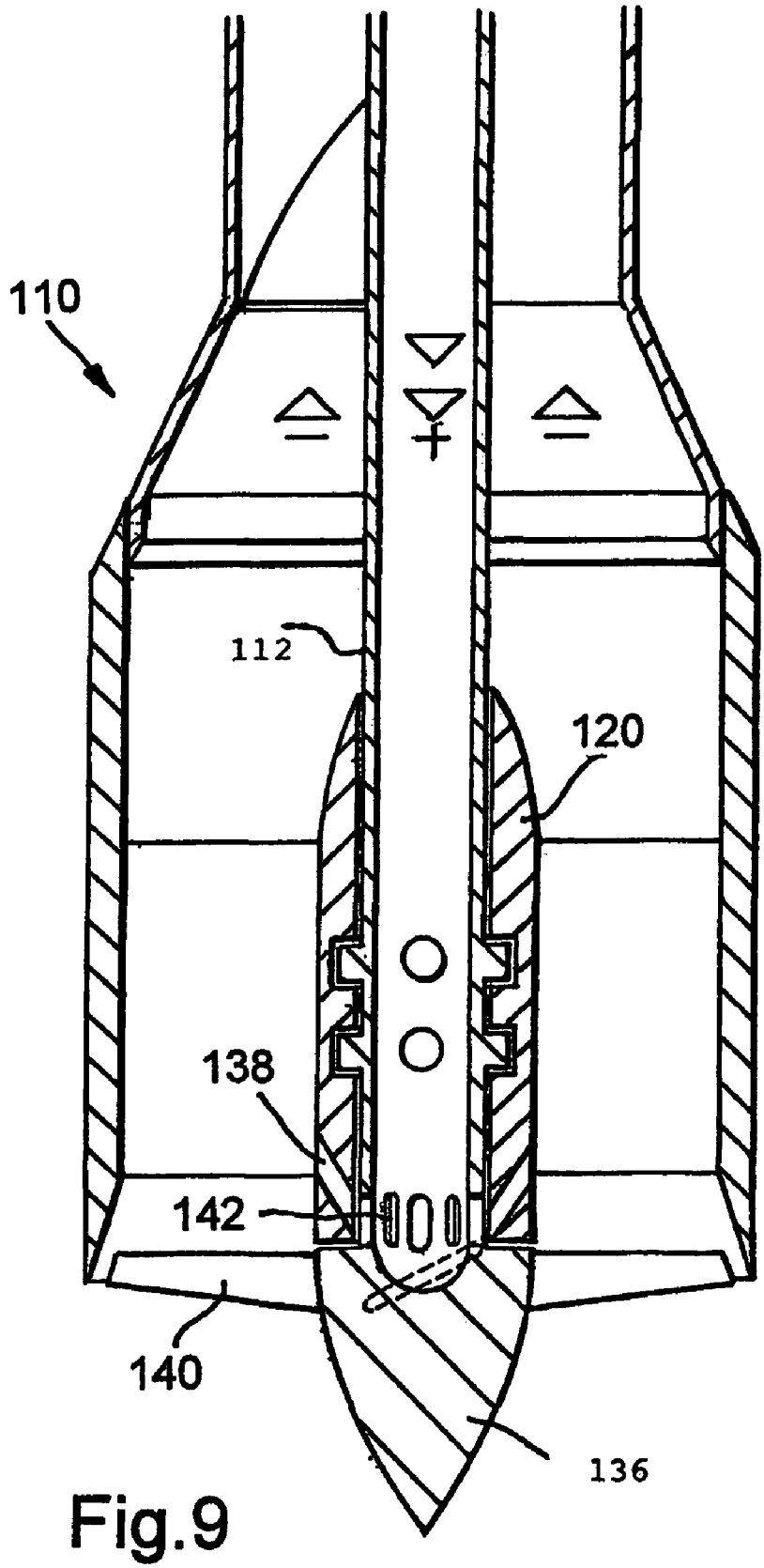
FIG. 9 shows a sectional view of a second embodiment of a boring apparatus in accordance with the present invention.

A second embodiment of the present invention is shown in FIG. 9. This boring apparatus 110 is similarly arranged to that described above, with the modification that the cam member 120 lacks a pointed nose for drilling. Instead, a nose 136 is formed from a forward portion of the drive shaft 112, the nose 136 being provided with radially protruding screw blades 140. A lead end of the drive shaft 112 is provided with a number of perforations 142 to allow air to pass from the drive shaft 112 out of the vents 138 of the cam member 120.

In use, rotation of the drive shaft 112 drives a reciprocal movement of the shroud 124, as before. However, since the nose 136 in this embodiment is formed as part of the drive shaft 112, the nose 136 and screw blades 140 have a purely rotational movement. This movement can be used to assist the boring or drilling action of the apparatus 110.

Figure 10:
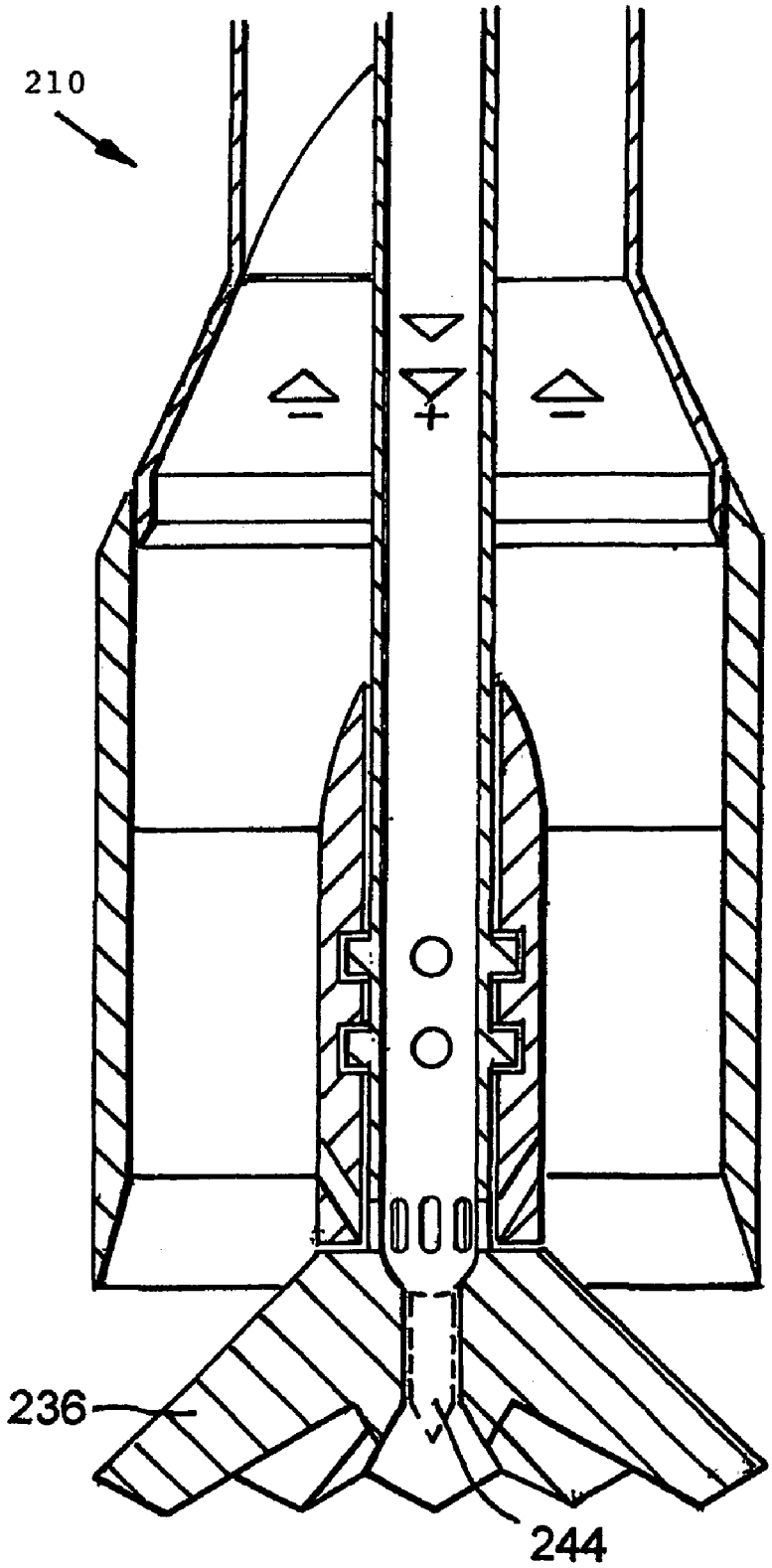
FIG. 10 shows a sectional view of a third embodiment of a boring apparatus in accordance with the present invention.

Similarly, a third embodiment of a boring apparatus 210, shown in FIG. 10, replaces the nose 136 with a grinding surface 236 for breaking up clumps of drilling substrayr. A removable plug 244 is provided in the grinding surface 236, and may be used to allow flow of compressed air to the grinding surface 236, both to assist removal of drilling waste and to cool the cutting surfaces.

Similarly, a third embodiment of a boring apparatus 210, shown in FIG. 10, replaces the nose 136 with a grinding surface 236 for breaking up clumps of drilling substrate. A removable plug 244 is provided in the grinding surface 236, and may be used to allow flow of compressed air to the grinding surface 236, both to assist removal of drilling waste and to cool the cutting surfaces.

Various other arrangements of nose configurations may be envisaged by the skilled person. In particular, although the two modifications so far described have the nose mounted directly on the drive shaft 112, 212, with the result that the nose experiences rotational movement only, it would be possible to mount the nose on a separate cam arrangement to impart both rotational and reciprocal movement to the nose piece; or to attach the nose piece loosely to the drive shaft, and also to the shroud to provide both rotational and reciprocal movement.

Figure 11:
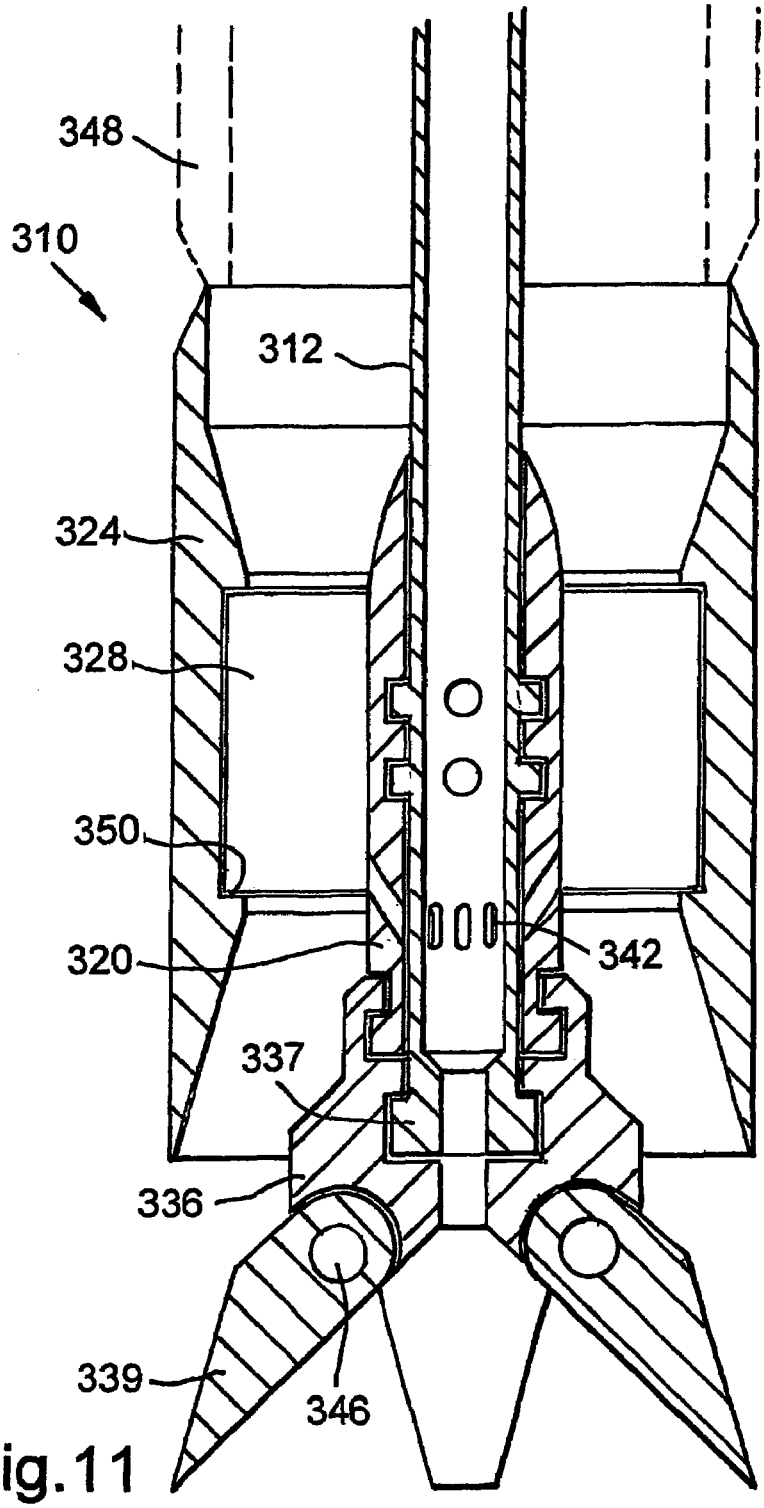
FIG. 11 shows a sectional view of a fourth embodiment of a boring apparatus in accordance with the present invention.

A further embodiment of a boring apparatus according to the present invention is shown in FIG. 11. The apparatus 310 is broadly similar to those described above. The grinding surface 236 of the embodiment of FIG. 10 is here replaced with a drill bit 336 which is loosely mounted to both the drive shaft 312 and the cam member 320. A number of keys 337 allow the drive shaft 312 to rotationally drive the drill bit 336, while the reciprocal movement in use of the cam member 320 drives reciprocal movement of the drill bit 336.

The drill bit 336 is also provided with a number of cutting teeth 339, which are mounted to the drill bit 336 by means of one-way hinges 346. These hinges allow the teeth 339 to retract when force is applied in the downward direction (as seen on the page), while the teeth 339 remain extended when an upward force, such as experienced when drilling, is applied.

It will be seen also from FIG. 11 that the spoil evacuation tube of the other embodiments are in this instance not present; instead a series of casing sections 348 are stacked above the shroud 324. The shroud 324 itself is modified somewhat in this embodiment; the radially extending spokes 328 are fixed only to the cam member 320, and are releasably retained in a number of pockets 350 located on the inner surface of the shroud 324; this feature is illustrated in more detail in FIGS. 14 to 16, and described below.

A fluid feed arrangement 342, 343, 348 is also provided to allow circulation of drilling fluid through the boring apparatus 310.

Figure 12:
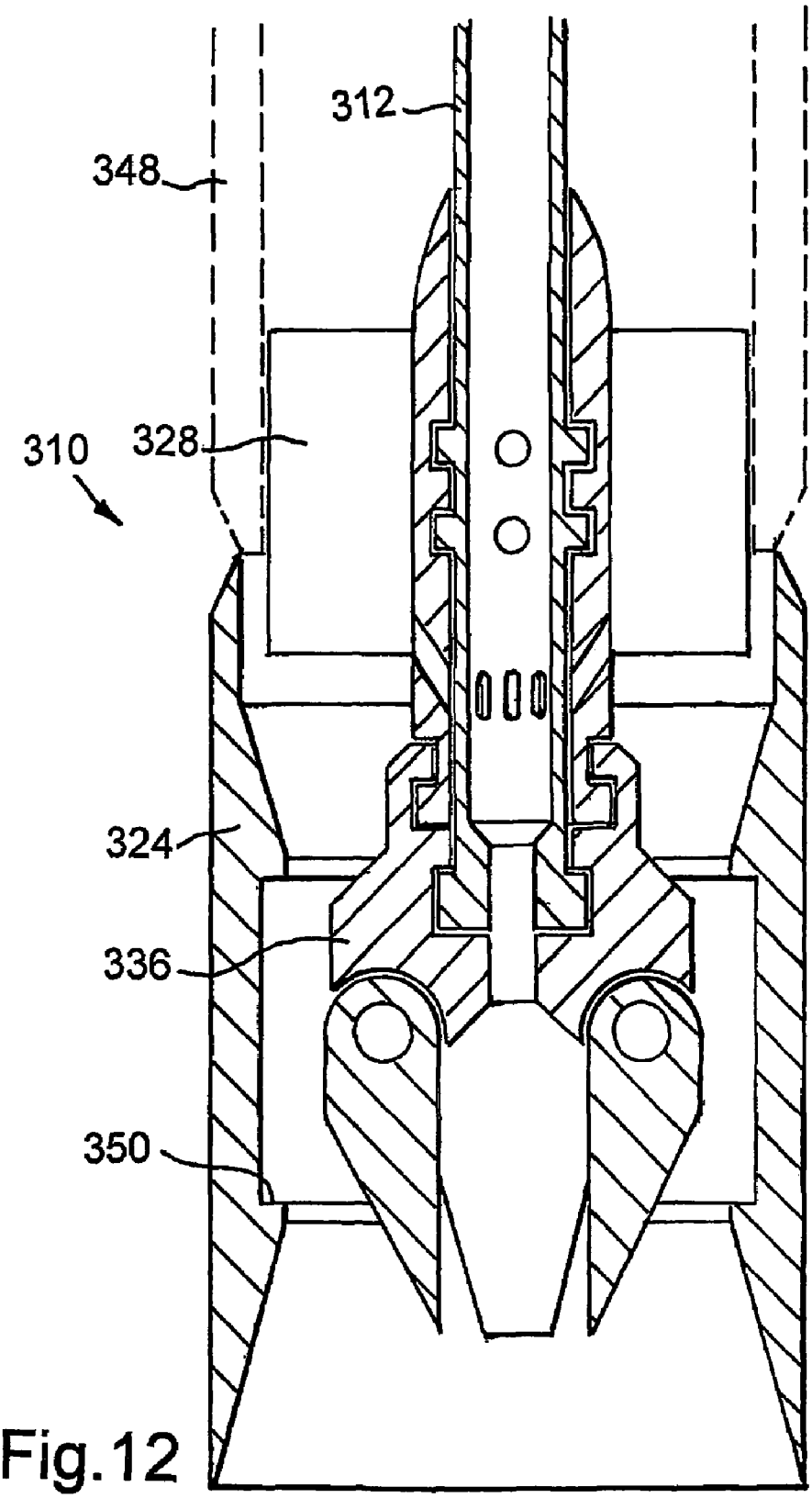
FIG. 12 shows the boring apparatus of FIG. 11 in an alternative configuration.

Referring now to FIG. 12, this shows the apparatus 310 of FIG. 11 in a second configuration. Once drilling of the bore is complete, and the bore is lined with casing sections 348, the drive shaft 312 and drill bit 336 will typically be removed from the bore. To achieve this, the drive shaft 312 is rotated in the opposite direction from that used for drilling, which causes the radial spokes 328 to disengage from the pockets 350 provided on the shroud 324.

Figure 14:
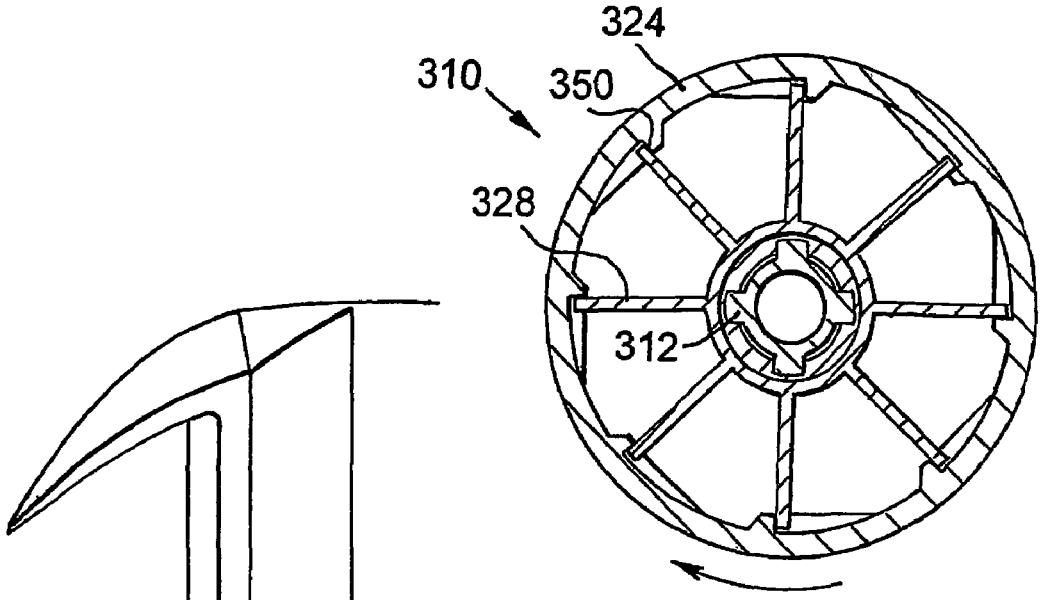
FIGS. 14 and 15 show radial cross-sectional views of the boring apparatus of FIGS. 11 and 12 in first and second positions.
Figure 13:
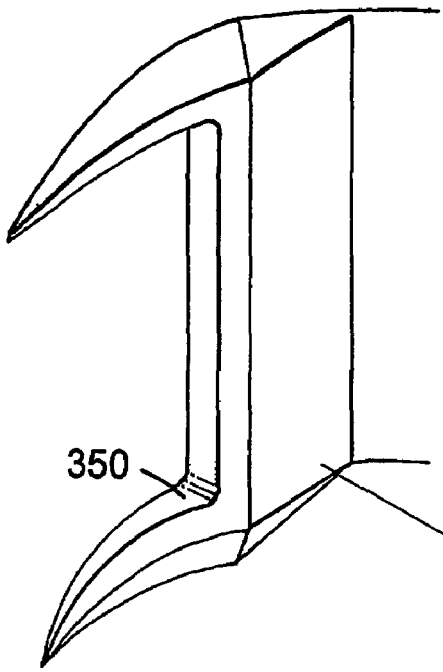
FIG. 13 shows a retaining pocket for a shroud of the apparatus of FIGS. 11 and 12.
Figure 15:
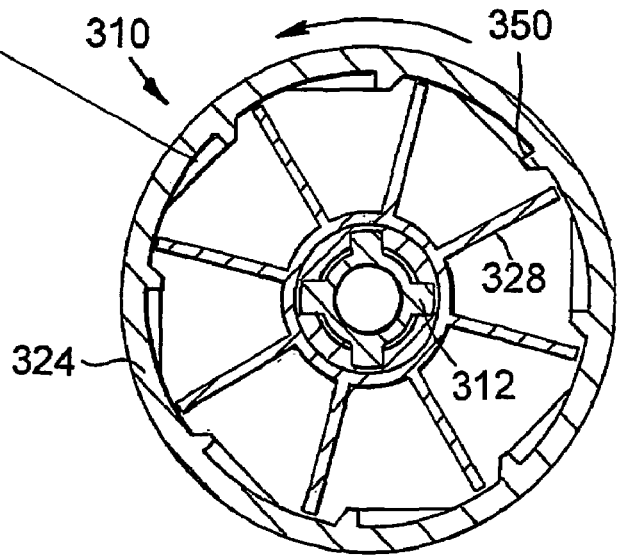

This process is illustrated in greater detail in FIGS. 13 to 15. Figure. 13 shows a single pocket 350 as may be provided on the shroud 324, in perspective view. It can be seen that the pocket 350 will engage with a spoke member moving against it in a first direction (into the pocket), but will release a spoke member moving in the opposite direction. FIGS. 14 and 15 show radial cross-sectional views of the boring apparatus 310 of FIGS. 11 and 12, and illustrate (FIG. 14) the rotation of the drive shaft 312 in a clockwise direction (as seen on the page) causing the spokes 328 to urge against the pockets 350, and carry the shroud 324 in the same clockwise rotational motion. When the direction of rotation of the drive shaft 312 is anti-clockwise (FIG. 15), the spokes 328 are moved out of engagement with the pockets 350, so detaching the shroud 324 from the drive shaft/spoke assembly.

As illustrated in FIG. 12, rotation of the drive shaft 312 to bring the spokes 328 out of engagement with the pockets 350 allows the drive shaft 312 and drill bit 336 to be raised toward surface, leaving the shroud 324 and casing sections 348 downhole. As the drill bit 336 is moved upward, the lower edges of the shroud 324 urge against the upper surfaces of the cutting teeth 339; the hinge arrangement 346 allows the teeth 339 to pivot inwardly toward the axis of the drill bit, so permitting the drill bit 336 to pass through the shroud 324 and casing sections 348.

Figure 16:
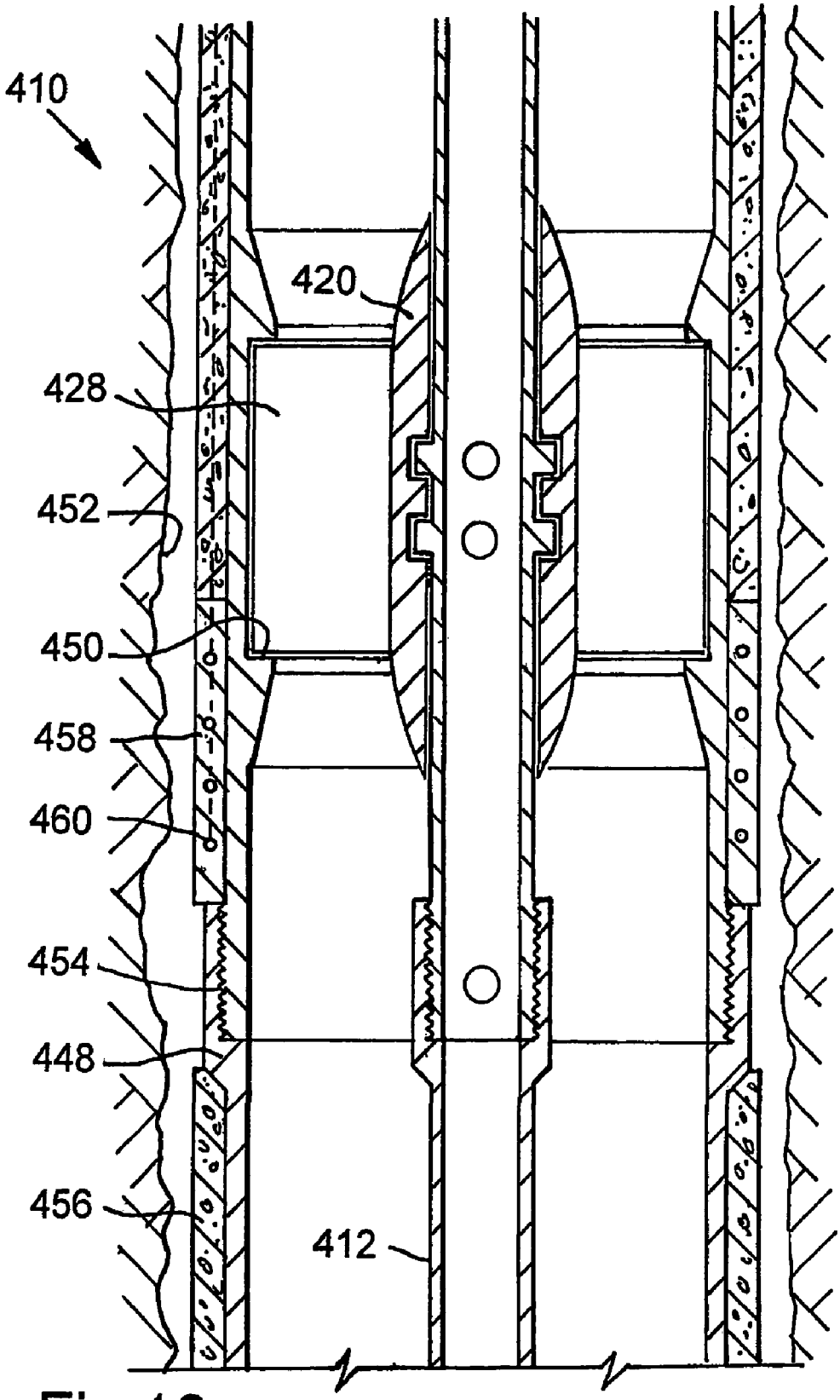
FIG. 16 shows a sectional view of a portion of a drill string assembly including a boring apparatus according to an embodiment of the present invention.

An upper portion of a drill string assembly 410 in accordance with an embodiment of the present invention is illustrated in FIG. 16. This drill string assembly 410 may be used in combination with the boring apparatus 310 of FIGS. 11 and 12. The drill string assembly 410 incudes a number of casing sections 448 disposed within a bore 452 and a drive shaft 412 extending axially within the casing sections 448. Each casing section 448 includes a casing joint 454 to couple the section 448 to an adjacent casing section.

Figure 17:
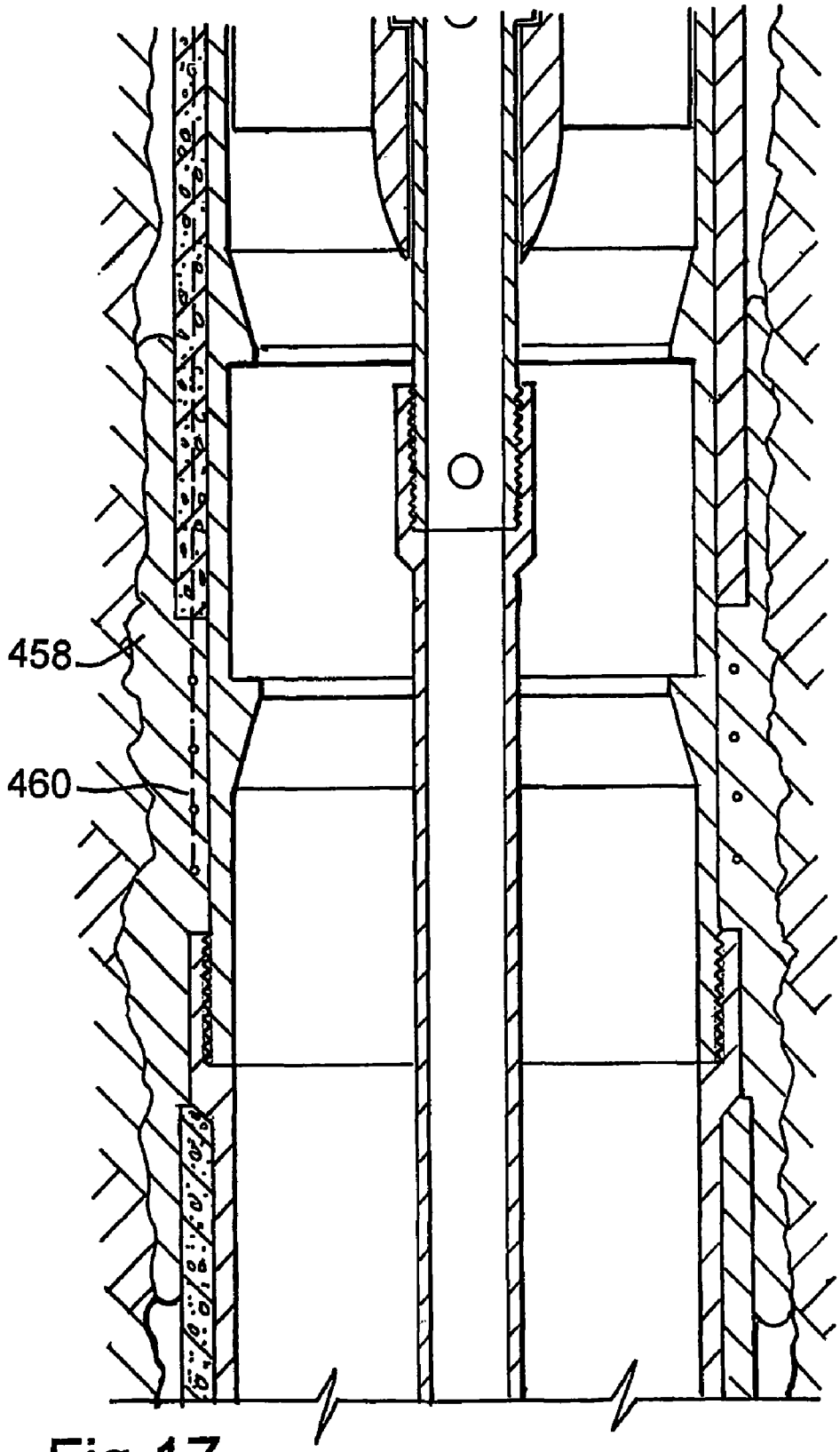
FIG. 17 shows the drill string assembly of FIG. 16 in an alternative configuration.

A number of casing sections along the drill string assembly 410 include a series of pockets 450 on an inner surface thereof, for releasably engaging with a cam member 420 and spoke 428 arrangement mounted to the drill string 412, in an equivalent manner to the cam member 320 and pocket 350 arrangement of the boring apparatus 310 of FIGS. 11 and 12. Thus, rotation of the drill string 412 in a first direction causes engagement of the spokes 428 with the pockets 450, while the cam member 420 arrangement causes reciprocal movement of the casing section 448. This reciprocal movement will serve to assist release of the casing string should the section 448 become obstructed or otherwise stuck within the bore. The spokes 428 may of course be disengaged from the casing string when desired, by rotation of the drill string 412 in a second direction, so allowing the drill string 412 arrangement to be removed from the borehole 452. This is illustrated in FIG. 17.

FIG. 16 also shows each casing section 448 bearing a coating of precast concrete 456. The concrete coating 456 does not extend the whole distance along the casing section 448; the end portions are left free of concrete to allow coupling of adjacent casing sections 448. However, there is provided on the lower portion of each casing section 448 a coating of intumescent material 458, such as that produced under the trade mark NOFIRE by Nofire Technologies Inc., of New Jersey, USA, having embedded therein an electrical heating element 460 connected to and controlled from surface.

When the borehole 452 is complete, and the drive shaft 412 assembly is removed from the casing string (see FIG. 17), the heating element 460 in the intumescent material 458 is activated. This raises the temperature of the material 458 to a predetermined level, causing the material 458 to intumesce. As the material 458 expands, it fills a portion of the space between the casing section 448 and the bore wall, and extends along the bore 452 to contact the adjacent concrete coatings 456. The material 458 cools and solidifies, to yield a foamed carbon 'plug' in the bore. This plug is impermeable to fluids, and so serves to prevent well fluids passing into the annulus between the casing and the bore, and also anchors the casing string to the bore wall. The bore can thus be used for production of well fluids without the need for an additional concreting or casing step. This allows more rapid drilling and casing of boreholes.

It will be seen that the present invention thus provides a boring or drilling apparatus which is able to form a borehole particularly in softer substrates without the need for a rotating drill bit. Further, the use of air flow to remove cuttings and cool the apparatus reduces the need for specialised drilling mud to be used.

In addition, the present invention allows drilling and casing of a wellbore to be effected in a single operation, without the requirement to trip out the drill string and introduce a separate casing string. Further, no separate concreting step is necessary.

Furthermore, although the apparatus has so far been described primarily with reference to use as part of a drill arrangement such as used in oil and gas industries, it will be clear to the skilled person that the invention may be used in many other boring or drilling applications, either as a component of a larger boring device, or as a standalone independent boring device, such as a remote operated or autonomous boring robot.

The invention claimed is:

1. A boring apparatus for boring a borehole, the apparatus comprising:

a rotatable drive shaft;

a boring member comprising a tubular member;

a mechanism for converting rotational motion of the drive shaft into longitudinal reciprocal motion of the boring member; and a rotational boring device provided ahead of the boring member, the rotational boring device being driven, in use, by the drive shaft;

wherein a leading end of the tubular member tapers from a main body portion of the tubular member to a peripherally extending leading edge thereof, and the leading edge comprises a cutting edge, which, in use, drills an outer circumference of the borehole.

2. The apparatus of claim 1, wherein the boring member further comprises a body mounted on the drive shaft.

3. The apparatus of claim 2, wherein the body is selectively engageable with the tubular member.

4. A boring member adapted for use in a boring apparatus according to claim 1, wherein the boring member comprises a tubular member and a leading end of the tubular member tapers from a main body portion of the tubular member to a peripherally extending leading edge thereof, and the leading edge comprises a cutting edge, which, in use, drills an outer circumference of the borehole.

5. A boring apparatus comprising:

a rotatable drive shaft;

a boring member comprising a tubular member;

a mechanism for converting rotational motion of the drive shaft into longitudinal reciprocal motion of the boring member; and a rotational boring device provided ahead of the boring member, the rotational boring device being driven, in use, by the drive shaft;

wherein a leading end of the tubular member tapers from a main body portion of the tubular member to a peripherally extending leading edge thereof;

wherein the boring member further comprises a body mounted on the drive shaft; and wherein the body is rigidly connected to the tubular member by one or more radially extending members.

6. A boring apparatus comprising:

a rotatable drive shaft;

a boring member comprising a tubular member;

a mechanism for converting rotational motion of the drive shaft into longitudinal reciprocal motion of the boring member; and a rotational boring device provided ahead of the boring member, the rotational boring device being driven, in use, by the drive shaft;

wherein a leading end of the tubular member tapers from a main body portion of the tubular member to a peripherally extending leading edge thereof;

wherein the boring member further comprises a body mounted on the drive shaft; and wherein the body and tubular member are arranged to engage or remain engaged on rotation of the body in a first direction, and disengage on rotation of the body in a second direction.

7. The apparatus of claim 6, wherein the apparatus comprises shaped recesses on one of the body and the tubular member for engaging with radially extending members connected to the other of the body and the tubular member.

8. A boring apparatus comprising:

a rotatable drive shaft;

a boring member comprising a tubular member;

a mechanism for converting rotational motion of the drive shaft into longitudinal reciprocal motion of the boring member; and a rotational boring device provided ahead of the boring member, the rotational boring device being driven, in use, by the drive shaft;

wherein the mechanism for converting rotational motion of the drive shaft to longitudinal motion of the boring member comprises at least one cam track arrangement on one of the drive shaft and boring member, and at least one corresponding cam follower member on the other of the drive shaft and the boring member.

9. The apparatus of claim 8, wherein the or each cam track is substantially sinusoidal in shape.

10. The apparatus of claim 8, wherein the or each cam track is non-sinusoidal in shape.

11. The apparatus of claim 8, further comprising an arrangement adapted to evacuate bored material from the boring member.

12. The apparatus of claim 8, comprising an arrangement adapted to direct a flow of gas such as air at material to be bored or which has been bored.

13. The apparatus of claim 8, wherein the boring member is further adapted for rotational motion as well as reciprocal motion.

14. The apparatus of claim 8, wherein the rotational boring device is further adapted for reciprocal motion as well as rotational motion.

15. A boring apparatus comprising:

a rotatable drive shaft;

a boring member comprising a tubular member;

a mechanism for converting rotational motion of the drive shaft into longitudinal reciprocal motion of the boring member; and a rotational boring device provided ahead of the boring member, the rotational boring device being driven, in use, by the drive shaft;

wherein the rotational boring device is adjustable to a position in which the radius of the rotational boring device is less than the radius of the boring member.

16. The apparatus of claim 15, wherein the rotational boring device comprises foldable or retractable cutting members.

17. An apparatus for boring, the apparatus comprising:

a rotatable drive shaft;

a drive mechanism for rotating the drive shaft;

a first drilling member comprising an annular shroud, the first drilling member being mounted on the drive shaft by a mounting arrangement, the mounting arrangement comprising a mechanism for converting at least some of the rotary motion of the drive shaft into reciprocal motion of the first drilling member;

a second drilling member arranged to extend beyond the first drilling member, the second drilling member being rotatably drivable by the drive shaft; and a fluid circulation arrangement for supplying fluid to the first drilling member and removing fluid therefrom.

18. The apparatus of claim 17, wherein the conversion mechanism converts only some of the rotary motion of the drive shaft into reciprocal motion, such that the first drilling member rotates while drilling in addition to reciprocating.

19. The apparatus of claim 17, wherein the fluid circulation arrangement is arranged to supply a gas to the first drilling member.

20. The apparatus of claim 17, wherein the mounting arrangement comprises a cam track arrangement on one of the drive shaft and first drilling member, and a cam follower member on the other of the drive shaft and first drilling member.

21. The apparatus of claim 17, wherein the cam follower is provided on the drive shaft, and the cam track is provided on the first drilling member.

22. The apparatus of claim 17, wherein the fluid circulation arrangement comprises a fluid delivery conduit extending to the drilling member and a fluid removal conduit extending from the first drilling member.

23. The apparatus of claim 22, wherein the drive shaft is hollow, and the fluid delivery conduit is formed by at least a portion of the drive shaft.

24. The apparatus of claim 22, wherein the fluid delivery conduit comprises one or more fluid delivery ports for permitting the escape of fluid from the conduit to the environment of the first drilling member.

25. The apparatus of claim 24, wherein the delivery ports are directed rearwardly with respect to the direction of fluid delivery flow.

26. The apparatus of claim 22, wherein the fluid removal conduit comprises a spoil evacuation tube.

27. The apparatus of claim 26, further comprising a shroud surrounding the fluid delivery conduit and directing fluid from the first drilling member to the fluid removal conduit.

28. The apparatus of claim 22, wherein the fluid removal conduit further comprises a lifting device for assisting the transport of fluid along the removal conduit.

29. The apparatus of claim 22, wherein the fluid delivery conduit is arranged to supply fluid under positive pressure to the first drilling member.

30. The apparatus of claim 17, wherein the annular shroud is arranged about a central mounting device for mounting the first drilling member on the drive shaft.

31. The apparatus of claim 30, wherein the annular shroud is releasably mounted to the drive shaft.

32. The apparatus of claim 30, wherein the annular shroud is provided with cutting edges for penetrating a drilling substrate.

33. The apparatus of claim 30, wherein the first drilling member further comprises a number of ribs or spokes connecting the central mounting device to the annular shroud.

34. The apparatus of claim 17, wherein the first drilling member is rotatably movable as well as reciprocally movable.

35. The apparatus of claim 17, wherein the second drilling member comprises part of the drive shaft.

36. The apparatus of claim 17, wherein the second drilling member is retractable or foldable to allow the second drilling member to be passed through the first drilling member.

37. The apparatus of claim 17, wherein the second drilling member is reciprocally movable as well as rotatably movable.

38. The apparatus of claim 17, adapted to be used in combination with a separate drilling support arrangement.

39. A drill string assembly comprising:

a rotatable drive shaft;

a drive device for rotating the drive shaft;

a tubular shroud; and a mounting device for selectively mounting the tubular shroud to the drive shaft, wherein the mounting device converts at least some rotary motion of the drive shaft to reciprocal motion of the tubular shroud;

a drilling member in the form of a drill head extending beyond and before the tubular shroud, the drilling member being rotatably drivable by the drive shaft; and a fluid circulation arrangement for supplying fluid to the tubular shroud and removing fluid therefrom.

40. The assembly of claim 39, wherein the drill head is operatively connected to the drive shaft to provide rotational motion of the drill head.

41. The assembly of claim 39, wherein the tubular shroud comprises a tubular member connected to a body, the body being mounted to the drive shaft.

42. The assembly of claim 39, further comprising one or more casing sections.

43. A drill string assembly comprising:

a rotatable drive shaft;

a drive device for rotating the drive shaft;

a tubular shroud; and a mounting device for selectively mounting the tubular shroud to the drive shaft, wherein the mounting device converts at least some rotary motion of the drive shaft to reciprocal motion of the tubular shroud; and a drilling member in the form of a drill head extending beyond and before the tubular shroud;

wherein the drill head is selectively movable between a first position of substantially the same radius as the tubular shroud, and a second position of lesser radius than the tubular shroud.

44. The assembly of claim 43, wherein the drill head comprises one or more hinged cutting blades which are foldable between first and second positions.

45. A drill string assembly comprising:

a rotatable drive shaft;

a drive device for rotating the drive shaft;

a tubular shroud; and a mounting device for selectively mounting the tubular shroud to the drive shaft, wherein the mounting device converts at least some rotary motion of the drive shaft to reciprocal motion of the tubular shroud;

a drilling member in the form of a drill head extending beyond and before the tubular Shroud; and one or more casing sections;

wherein the casing sections include precast concrete or similar coatings.

46. A drill string assembly comprising:

a rotatable drive shaft;

a drive device for rotating the drive shaft;

a tubular shroud; and a mounting device for selectively mounting the tubular shroud to the drive shaft, wherein the mounting device converts at least some rotary motion of the drive shaft to reciprocal motion of the tubular shroud;

a drilling member in the form of a drill head extending beyond and before the tubular Shroud; and one or more casing sections;

further comprising intumescent coatings on selected portions of the casing sections.

47. The assembly of claim 46, wherein the intumescent coatings are selected to intumesce at a selected predetermined temperature.

48. The assembly of claim 47, further comprising a device for heating the intumescent coatings.

49. The assembly of claim 48, wherein the heating device comprises heating elements embedded in the intumescent coatings, and operable from surface.

50. The assembly of claim 46, wherein the intumescent coatings are provided adjacent joints between successive casing sections.

51. A method of drilling and casing a wellbore, the method comprising the steps of:

running a drill string assembly into a bore, the assembly comprising a rotatable drive shaft, a drive device for rotating the drive shaft, a tubular shroud, a mounting device for selectively mounting the tubular shroud to the drive shaft and for convening at least some of the rotary motion of the drive shaft to reciprocal motion of the tubular shroud, and a drilling member in the form of a drill head extending beyond and before the tubular shroud;

running at least one casing section into the bore on the drill string assembly;

unmounting the tubular shroud from the drive shaft; and removing the drilling member and the drive shaft from the bore, to leave the tubular shroud and the casing sections in the bore.

52. A boring apparatus comprising:

a rotatable drive shaft;

a boring member; and a mechanism for convening rotational motion of the drive shaft into longitudinal reciprocal motion of the boring member;

wherein the mechanism for convening rotational motion of the drive shaft into longitudinal reciprocal motion of the boring member comprises at least one cam track arrangement on one of the drive shaft and the boring member, and at least one corresponding cam follower member on the other of the drive shaft and the boring member;

wherein the at least one cam track arrangement is substantially sinusoidal in shape.

53. An apparatus for boring, the apparatus comprising:

a rotatable drive shaft;

a drive mechanism for rotating the drive shaft;

a drilling member mounted on the drive shaft by a mounting arrangement, the mounting arrangement comprising a mechanism for converting at least some rotary motion of the drive shaft into reciprocal motion of the drilling member; and a fluid circulation arrangement for supplying fluid to the drilling member and removing fluid therefrom;

wherein the fluid circulation arrangement comprises a fluid delivery conduit extending to the drilling member, and a fluid removal conduit extending from the drilling member, wherein the fluid delivery conduit comprises one or more fluid delivery ports for permitting escape of fluid from the fluid delivery conduit to environment of the drilling member, the fluid delivery ports being directed rearwardly with respect to a direction of fluid delivery flow.

54. A drill string assembly comprising:

a rotatable drive shaft;

a drive device for rotating the drive shaft;

a tubular shroud;

a mounting device for selectively mounting the tubular shroud to the drive shaft;

one or more casing sections comprising intumescent coatings on selected portions thereof, the intumescent coatings being selected to intumesce at a selected predetermined temperature; and a heating device for heating the intumescent coatings, the heating device comprising heating elements embedded in the intumescent coatings, and operable from surface.

55. A drill string assembly comprising:

a rotatable drive shaft;

a drive device for rotating the drive shaft;

a tubular shroud;

a mounting device for selectively mounting the tubular shroud to the drive shaft; and one or more casing sections comprising intumescent coatings on selected portions thereof, the intumescent coatings being provided adjacent joints configured to be disposed between successive casing sections.

* * * * *

UNITED STATES PATENT AND TRADEMARK OFFICE

CERTIFICATE OF CORRECTION

PATENT NO. : 7,410,013 B2
APPLICATION NO. : 10/450066
DATED : August 12, 2008
INVENTOR(S) : Fisher It is certified that error appears in the above-identified patent and that said Letters Patent is hereby corrected as shown below:

In claim 45, Col. 15, line 17, replace “Shroud” with --shroud--.

In claim 46, Col. 15, line 30, replace “Shroud” with --shroud--.

In claim 52, Col. 16, lines 4 and 7, replace “convening” with --converting--.

Signed and Sealed this

Sixteenth Day of September, 2008

JON W. DUDAS
*Director of the United States Patent and Trademark Office*